US010709248B2

(12) United States Patent
Racanelli

(10) Patent No.: US 10,709,248 B2
(45) Date of Patent: Jul. 14, 2020

(54) POSTURE IMPROVEMENT ASSEMBLY

(71) Applicant: Maria Racanelli, Dobbs Ferry, NY (US)

(72) Inventor: Maria Racanelli, Dobbs Ferry, NY (US)

( * ) Notice: Subject to any disclaimer, the term of this patent is extended or adjusted under 35 U.S.C. 154(b) by 0 days.

(21) Appl. No.: 16/127,961

(22) Filed: Sep. 11, 2018

(65) Prior Publication Data

US 2020/0077799 A1 Mar. 12, 2020

(51) Int. Cl.

| | |
|---|---|
| ***A47C 7/42*** | (2006.01) |
| ***A47C 16/00*** | (2006.01) |
| ***A47C 7/40*** | (2006.01) |

(52) U.S. Cl.

CPC ..... *A47C 7/425* (2013.01); *A47C 7/402* (2013.01); *A47C 16/005* (2013.01)

(58) Field of Classification Search

CPC ..... A47C 7/425; A47C 16/005; A47C 7/402; A47C 7/42

USPC ..... 297/230.1, 230.12, 230.13, 230.14

See application file for complete search history.

(56) References Cited

U.S. PATENT DOCUMENTS

| | | | | |
|---|---|---|---|---|
| 1,234,571 | A * | 7/1917 | Robideau | A47C 7/425 297/230.13 |
| 2,835,311 | A | 5/1958 | Reeves | |
| 5,060,754 | A * | 10/1991 | Feick | A47C 9/025 182/113 |
| 5,251,957 | A | 10/1993 | Lemens | |
| 5,707,108 | A * | 1/1998 | Pi | A47C 7/425 297/184.1 |
| 8,459,737 | B2 | 6/2013 | Brotsch | |
| 8,668,270 | B2 | 3/2014 | Ciepiela | |
| 8,740,307 | B1 | 6/2014 | Thomas | |
| 2017/0049655 | A1 | 2/2017 | Sung | |

FOREIGN PATENT DOCUMENTS

| | | | | |
|---|---|---|---|---|
| DE | 4228637 A1 * | 3/1994 | ..... | A47C 7/402 |

* cited by examiner

*Primary Examiner* — Milton Nelson, Jr.

(57) ABSTRACT

A posture improvement assembly includes a base that has a top side and a bottom side and is elongated from a first lateral edge to a second lateral edge. A panel has a top edge and a bottom edge wherein the bottom edge is attached to the top side of the base and extends upwardly therefrom. The bottom edge is oriented parallel to a longitudinal axis extending through the first and second lateral edges. The panel lies in a plane orientated perpendicular to a plane of the bottom side of the base. The panel is telescopic and has an adjustable height. A locking member is mechanically coupled to the panel and releasably locks the panel at a selected height. A cushion is attached to and covers the top edge. The base is positioned on a chair to allow a person to place their back against the panel.

8 Claims, 5 Drawing Sheets

POSTURE IMPROVEMENT ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to posture enhancing devices and more particularly pertains to a new posture enhancing device for encouraging a person to sit upright while seated in a chair.

BRIEF SUMMARY OF THE INVENTION

An embodiment of the disclosure meets the needs presented above by generally comprising a base that has a front edge, a rear edge, a first lateral edge, a second lateral edge, a top side and a bottom side. The base is elongated from the first lateral edge to the second lateral edge. A panel has a top edge, a bottom edge, a front side, a back side, a first side edge and a second side edge. The bottom edge is attached to the top side of the base and extends upwardly therefrom. The bottom edge is oriented parallel to a longitudinal axis extending through the first and second lateral edges. The panel lies in a plane orientated perpendicular to a plane of the bottom side of the base. The panel is telescopic and has an adjustable height. A locking member is mechanically coupled to the panel and releasably locks the panel at a selected height. A cushion is attached to and covers the top edge.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
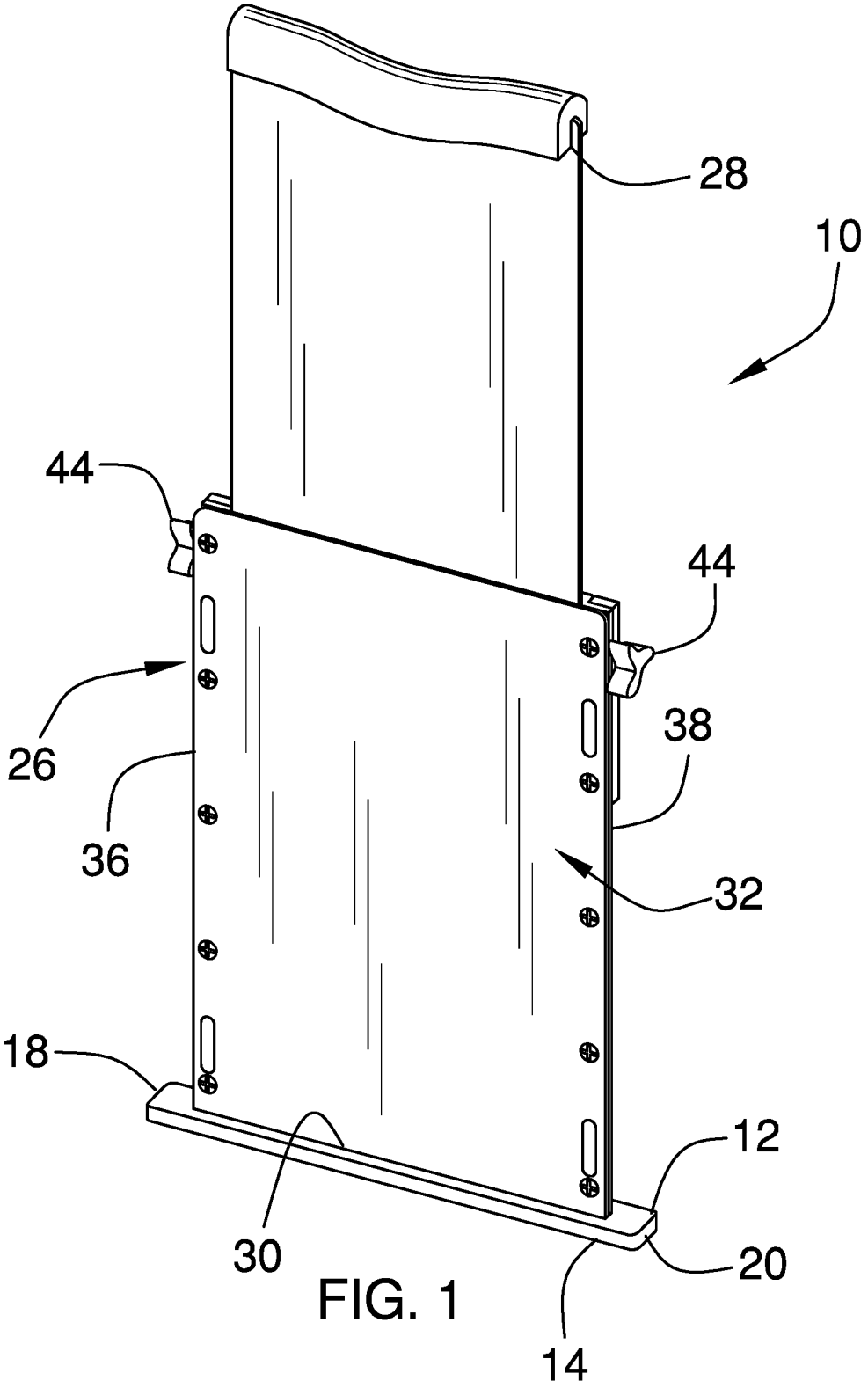
FIG. 1 is a front isometric view of a posture improvement assembly according to an embodiment of the disclosure.
Figure 4:
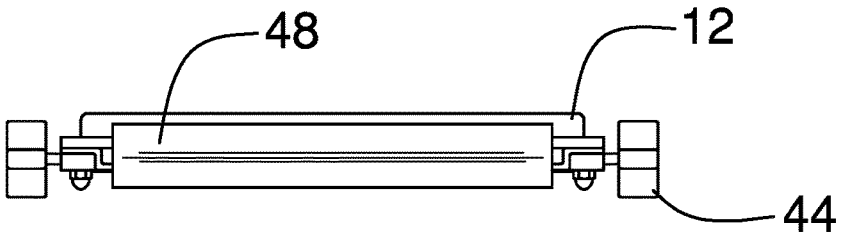
FIG. 4 is a top view of an embodiment of the disclosure.
Figure 2:
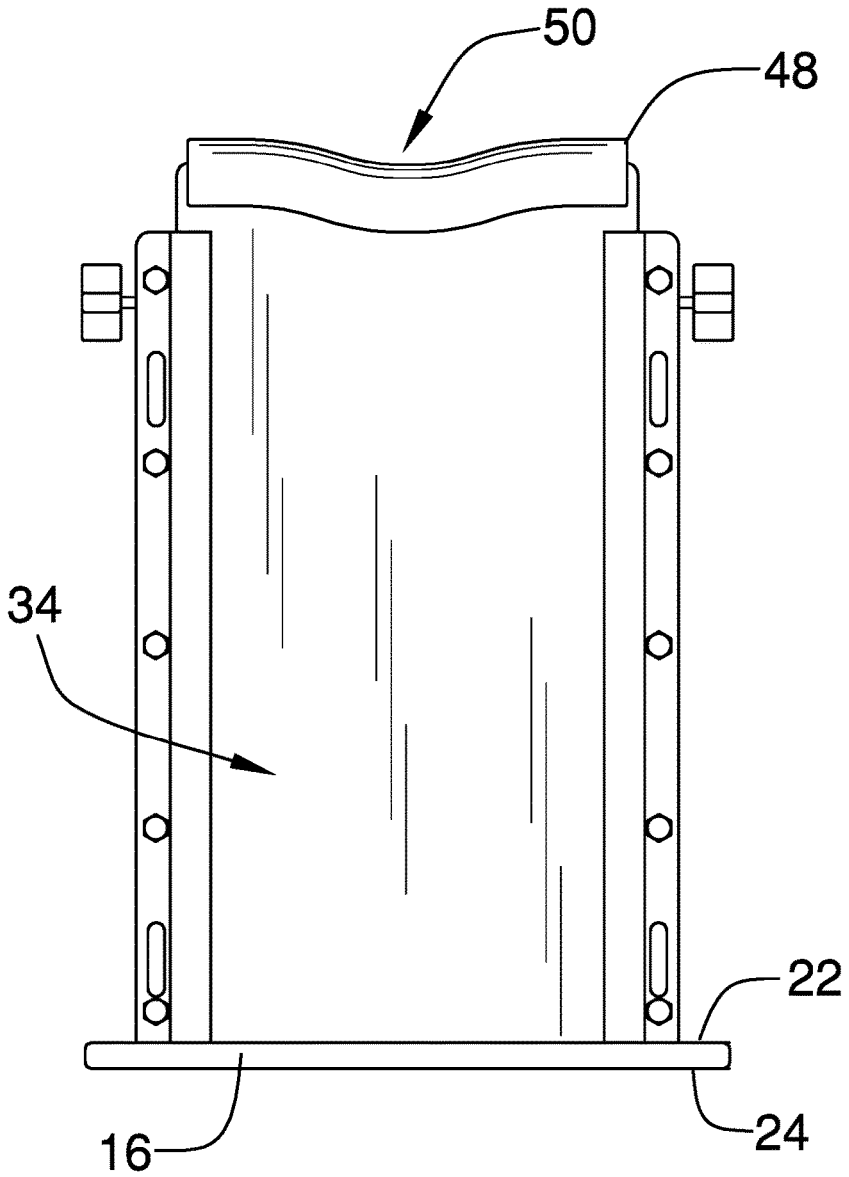
FIG. 2 is a rear view of an embodiment of the disclosure.
Figure 3:
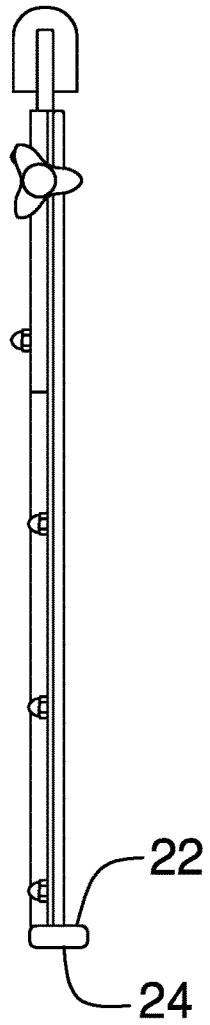
FIG. 3 is a side view of an embodiment of the disclosure.
Figure 5:
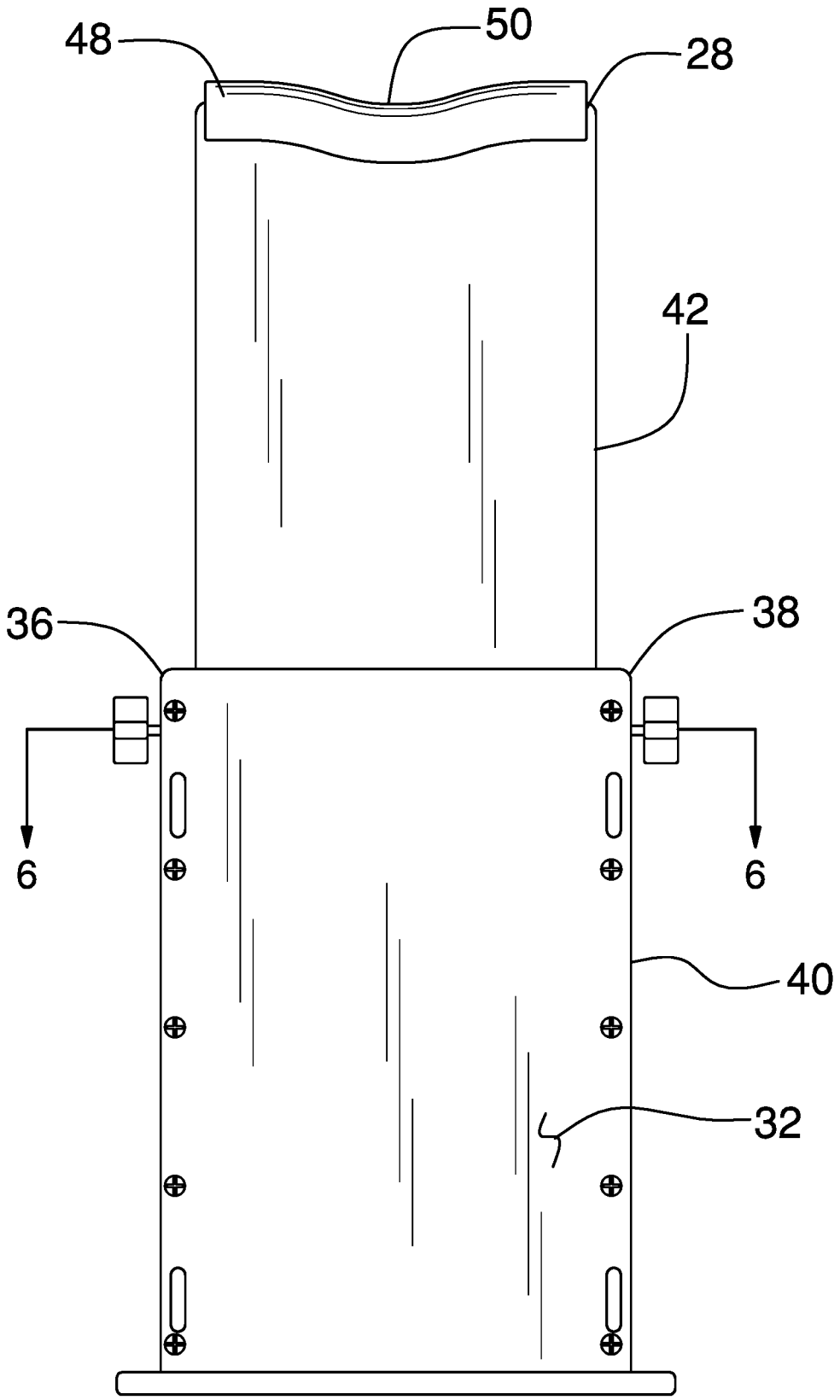
FIG. 5 is a front view of an embodiment of the disclosure.

With reference now to the drawings, and in particular to FIGS. 1 through 7 thereof, a new posture enhancing device embodying the principles and concepts of an embodiment of the disclosure and generally designated by the reference numeral 10 will be described.

As best illustrated in FIGS. 1 through 7, the posture improvement assembly 10 generally comprises a base 12 that has a front edge 14, a rear edge 16, a first lateral edge 18, a second lateral edge 20, a top side 22 and a bottom side 24. The base 12 is elongated from the first lateral edge 18 to the second lateral edge 20. The base 12 has a height from the top side 22 to the bottom side 24 is less than 1.5 inches and a depth from the front edge 14 to the rear edge 16 is between 1.0 inches and 2.0 inches. The base 12 may have a length from the first lateral edge 18 to the second lateral edge 20 that is between 12.0 inches and 16.0 inches.

A panel 26 has a top edge 28, a bottom edge 30, a front side 32, a back side 34, a first side edge 36 and a second side edge 38. The bottom edge 30 is attached to the top side 22 of the base 12 such that the panel 26 extends upwardly from the base 12. The bottom edge 30 is oriented parallel to a longitudinal axis extending through the first 18 and second 20 lateral edges and the panel 26 lies in a plane orientated perpendicular to a plane of the bottom side 24 of the base 12. Thus, the panel 26 generally extends between the first 18 and second 20 lateral edges and is orientated perpendicular to the top side 22 of the base 12. The bottom edge 30 is spaced from the front edge 14 such that a forward extending flange of the base 12 is defined. The panel 26 has a width from the first side edge 36 to the second side edge 38 that is less than a length of the base 12 and is at least equal to or greater than 10.0 inches.

More particularly, the panel 26 is telescopic such that the panel 26 has an adjustable height. The panel 26 may comprise a first section 40 including the bottom edge 30 and a second section 42 including the top edge 28, wherein the first 40 and second 42 sections are vertically moveable relative to each other. The panel 26 is adjustable between a lowest height equal to between 16.0 inches and 20.0 inches and a greatest height equal to between 30.0 inches and 35.0 inches.

Figure 6:
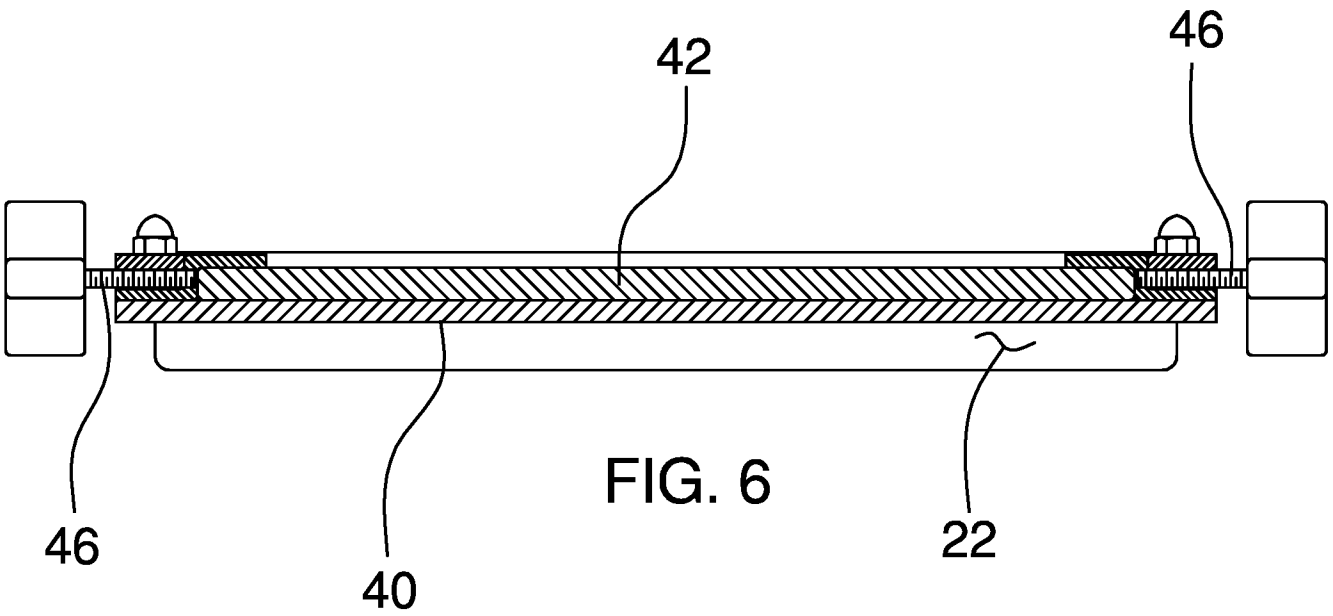
FIG. 6 is a cross-sectional view of an embodiment of the disclosure taken along line 6-6 of FIG. 1.
Figure 7:
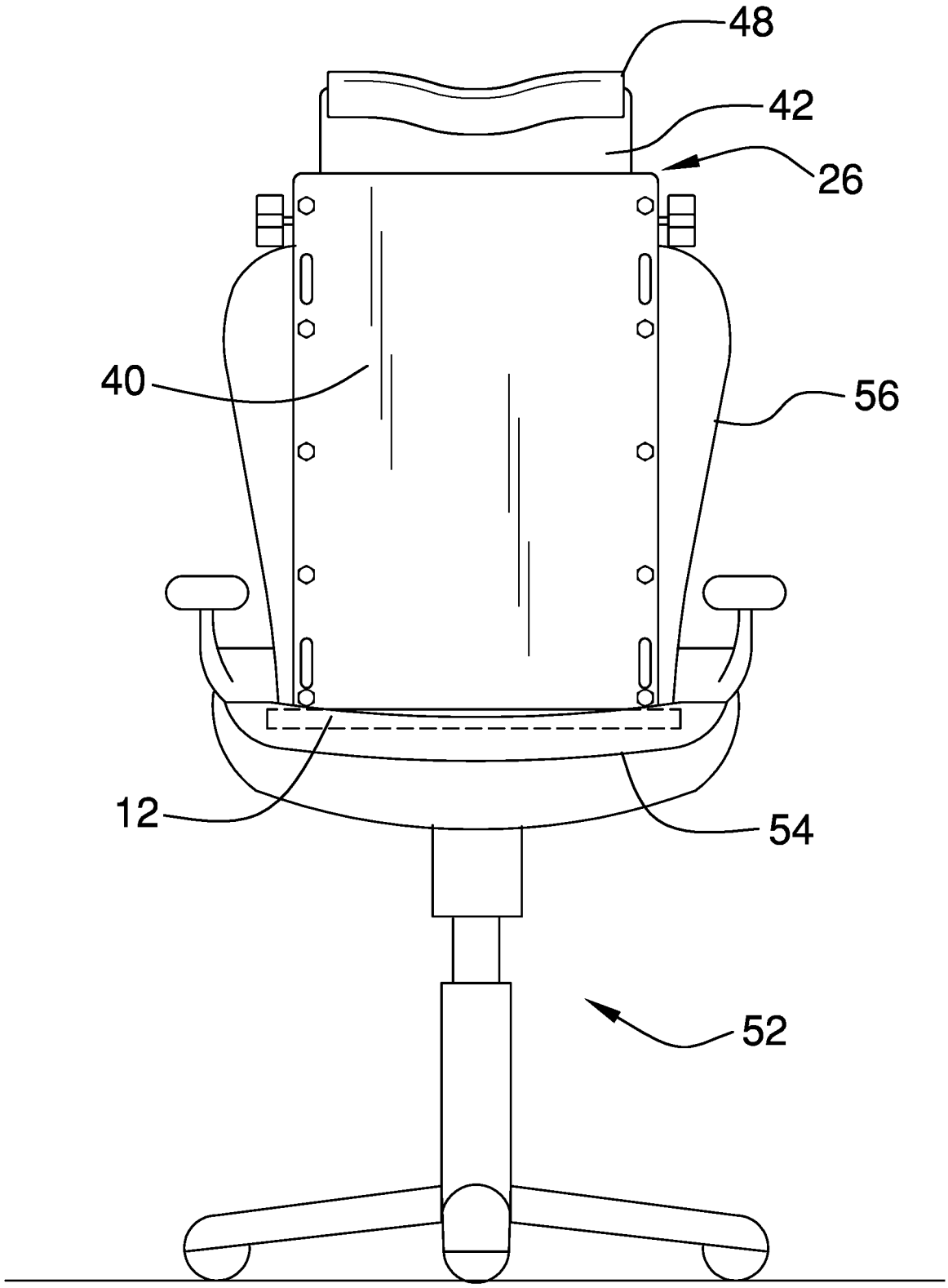
FIG. 7 is a front in-use view of an embodiment of the disclosure.

A locking member 44 is mechanically coupled to the panel 26 and releasably locks the first 40 and second 42 sections at a selected position relative to each other. As can be seen in FIG. 6, the locking member 44 may include a pair of threaded members 46 that may be tightened against and abut the second section 42 so that it is retained in position relative to the first section 40.

A cushion 48 may be attached to and cover all or a portion of the top edge 28. The cushion 48 has a central area 50 has an upper surface that is concavely arcuate to better receive and support a bottom of person's head adjacent to their neck. The top edge 28 itself may be concavely arcuate and the cushion 48 fitted to follow the contours of the top edge 28 or the cushion 48 itself may be shaped to have the arcuate edge.

In use, the base 12 is positioned on a seat 54 of a chair 52 adjacent to the backrest 56 thereof such that the panel 26 is supported by the backrest 56. The user adjusts the height of the panel 26 to accommodate their height and then sits on the chair 52 with their back positioned against the panel 26. The panel 26 reinforces the understanding that the person should sit upright to improve their posture which in turn improves muscle tone and overall health.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A posture improvement assembly configured to be positioned on a chair such that a person places their back against the assembly, the assembly comprising:

a base having a front edge, a rear edge, a first lateral edge, a second lateral edge, a top side and a bottom side, the base being elongated from the first lateral edge to the second lateral edge;

a panel having a top edge, a bottom edge, a front side, a back side, a first side edge and a second side edge, the bottom edge being attached to the top side of the base and extending upwardly therefrom, the bottom edge being oriented parallel to a longitudinal axis extending through the first and second lateral edges, the panel lying in a plane orientated perpendicular to a plane of the bottom side of the base;

the panel being telescopic and having an adjustable height;

a locking member being mechanically coupled to the panel and releasably locking the panel at a selected height;

a cushion being attached to and covering the top edge; and wherein the panel has a width from the first side edge to the second side edge being less than a length of the base and being at least equal to or greater than 10.0 inches.

2. A posture improvement assembly configured to be positioned on a chair such that a person places their back against the assembly, the assembly comprising:

a base having a front edge, a rear edge, a first lateral edge, a second lateral edge, a top side and a bottom side, the base being elongated from the first lateral edge to the second lateral edge, the base having a height from the top side to the bottom side being less than 1.5 inches, the base having a depth from the front edge to the rear edge being between 1.0 inches and 2.0 inches, the base having a length from the first lateral edge to the second lateral edge being between 12.0 inches and 16.0 inches;

a panel having a top edge, a bottom edge, a front side, a back side, a first side edge and a second side edge, the bottom edge being attached to the top side of the base and extending upwardly therefrom, the bottom edge being oriented parallel to a longitudinal axis extending through the first and second lateral edges, the panel lying in a plane orientated perpendicular to a plane of the bottom side of the base;

the panel being telescopic and having an adjustable height, the panel comprising a first section including the bottom edge and a second section including the top edge, the panel being adjustable between a lowest height equal to between 16.0 inches and 20.0 inches and a greatest height equal to between 30.0 inches and 35.0 inches;

the panel having a width from the first side edge to the second side edge being less than a length of the base and being at least equal to or greater than 10.0 inches;

the bottom edge being spaced from the front edge;

a locking member being mechanically coupled to the panel and releasably locking the first and second sections at a selected position relative to each other; and a cushion being attached to and covering the top edge, the cushion having a central area having an upper surface being concavely arcuate.

3. A posture improvement assembly configured to be positioned on a chair such that a person places their back against the assembly, the assembly comprising:

a base having a front edge, a rear edge, a first lateral edge, a second lateral edge, a top side and a bottom side, the base being elongated from the first lateral edge to the second lateral edge;

a panel having a top edge, a bottom edge, a front side, a back side, a first side edge and a second side edge, the bottom edge being attached to the top side of the base and extending upwardly therefrom, the bottom edge being oriented parallel to a longitudinal axis extending through the first and second lateral edges, the panel lying in a plane orientated perpendicular to a plane of the bottom side of the base;

the panel being telescopic and having an adjustable height;

a locking member being mechanically coupled to the panel and releasably locking the panel at a selected height;

a cushion being attached to and covering the top edge; and wherein the base has a depth from the front edge to the rear edge being between 1.0 inches and 2.0 inches.

4. The posture improvement assembly according to claim 3, wherein the bottom edge is spaced from the front edge.

5. The posture improvement assembly according to claim 3, wherein the panel comprises a first section including the bottom edge and a second section including the top edge, the locking member releasably locking the first and second sections at a selected position relative to each other.

6. A posture improvement assembly configured to be positioned on a chair such that a person places their back against the assembly, the assembly comprising:

a base having a front edge, a rear edge, a first lateral edge, a second lateral edge, a top side and a bottom side, the base being elongated from the first lateral edge to the second lateral edge;

a panel having a top edge, a bottom edge, a front side, a back side, a first side edge and a second side edge, the bottom edge being attached to the top side of the base and extending upwardly therefrom, the bottom edge being oriented parallel to a longitudinal axis extending through the first and second lateral edges, the panel lying in a plane orientated perpendicular to a plane of the bottom side of the base;

the panel being telescopic and having an adjustable height;

a locking member being mechanically coupled to the panel and releasably locking the panel at a selected height;

a cushion being attached to and covering the top edge;

wherein the panel comprises a first section including the bottom edge and a second section including the top edge, the locking member releasably locking the first and second sections at a selected position relative to each other; and wherein the panel is adjustable between a lowest height equal to between 16.0 inches and 20.0 inches and a greatest height equal to between 30.0 inches and 35.0 inches.

7. A posture improvement assembly configured to be positioned on a chair such that a person places their back against the assembly, the assembly comprising:

a base having a front edge, a rear edge, a first lateral edge, a second lateral edge, a top side and a bottom side, the base being elongated from the first lateral edge to the second lateral edge;

a panel having a top edge, a bottom edge, a front side, a back side, a first side edge and a second side edge, the bottom edge being attached to the top side of the base and extending upwardly therefrom, the bottom edge being oriented parallel to a longitudinal axis extending through the first and second lateral edges, the panel lying in a plane orientated perpendicular to a plane of the bottom side of the base;

the panel being telescopic and having an adjustable height;

a locking member being mechanically coupled to the panel and releasably locking the panel at a selected height;

a cushion being attached to and covering the top edge; and wherein the panel is adjustable between a lowest height equal to between 16.0 inches and 20.0 inches and a greatest height equal to between 30.0 inches and 35.0 inches.

8. A posture improvement assembly configured to be positioned on a chair such that a person places their back against the assembly, the assembly comprising:

a base having a front edge, a rear edge, a first lateral edge, a second lateral edge, a top side and a bottom side, the base being elongated from the first lateral edge to the second lateral edge;

a panel having a top edge, a bottom edge, a front side, a back side, a first side edge and a second side edge, the bottom edge being attached to the top side of the base and extending upwardly therefrom, the bottom edge being oriented parallel to a longitudinal axis extending through the first and second lateral edges, the panel lying in a plane orientated perpendicular to a plane of the bottom side of the base;

the panel being telescopic and having an adjustable height;

a locking member being mechanically coupled to the panel and releasably locking the panel at a selected height;

a cushion being attached to and covering the top edge; and wherein the base has a length from the first lateral edge to the second lateral edge being between 12.0 inches and 16.0 inches.

* * * * *